US005803437A

United States Patent [19]

Paterson et al.

[11] Patent Number: 5,803,437

[45] Date of Patent: Sep. 8, 1998

[54] CHAINLESS DRIVE WINCH

[76] Inventors: Richard Paterson, 413 Dixon Boulevard, Newmarket, Ontario, Canada, L3Y 5C5; Patrick Kelly, 6823 Summer Heights Drive, Mississauga, Ontario, Canada, L5N 7E7

[21] Appl. No.: 824,156

[22] Filed: Mar. 26, 1997

[51] Int. Cl.[6] ..... B66D 1/00

[52] U.S. Cl. ..... 254/343; 254/378; 254/333; 254/335; 254/276

[58] Field of Search ..... 254/343, 378, 254/276, 333, 335

[56] References Cited

U.S. PATENT DOCUMENTS

| | | | |
|---|---|---|---|
| 1,756,459 | 4/1930 | Gormley | 254/343 |
| 2,884,800 | 5/1959 | Carroll | 254/343 |
| 3,042,375 | 7/1962 | Fahey et al. | 254/343 |
| 3,222,002 | 12/1965 | Holberg | 254/276 |
| 4,176,827 | 12/1979 | Anderson et al. | 254/343 |
| 4,884,783 | 12/1989 | McIntosh et al. | 254/343 |
| 5,660,373 | 8/1997 | Maslo et al. | 254/343 |

*Primary Examiner*—Katherine Matecki
*Attorney, Agent, or Firm*—Jane Parsons

[57] ABSTRACT

A chainless drive winch is provided having a cable cylinder meshing with an orthogonal, cylindrical reduction gearing member. The reduction gearing member may be driven by, for example, an electric motor. A brake is provided operable only when the reduction gearing member is rotated is a direction to lower a load. Limit switches may be provided which are adjustable to alter the distance between them. A trigger finger moving between the limit switches is driven from the cable cylinder. The cable cylinder may be provided with a generally parallel roller to hold turns of cable on the cylinder. The roller may be independently biased at each end so that, when cable is partially unwound from the cylinder, the bias of the roller is enhanced on the remaining turns.

20 Claims, 8 Drawing Sheets

CHAINLESS DRIVE WINCH

BACKGROUND OF THE INVENTION

1. Field of the Invention

This invention relates to a winch. Especially this invention relates to a winch for lifting medium weight articles such as basketball backstops, or other gymnasium equipment.

2. Acknowledgement of Prior Art

Existing winches typically use belt or chain drives in conjunction with standard enclosed oil bath type worm drives. They tend to be bulky and heavy and require periodic adjustment of belts, etc. With extended use oil leaks can develop which is a hazard in gymnasium situations where oil may get on the floor.

With wear and polishing of the mating surfaces, even high ratio worn gears can "back-drive" under vibration conditions or when the inertia of the motor coupled with the dynamic lubrications affects the motion of the drum in the downward direction after the power has been shut-off.

Winches of the type described may utilize rope or wire cable or wire. The term "rope" will be used herein to encompass all normally used winch cables.

Rope anchorage is frequently a weak point on conventional winches. Sometimes the rope is secured with only two set screws clamping its end.

The limit switches on conventional winches are typically contrived as an add-on feature requiring shaft couplings and careful alignment.

Such switches are awkward to adjust accurately. Frequent problems occur when the rope either become slack on the cylinder and jumps out of the grooves where provided or does not track evenly across the cylinder creating undue wear on the rope and negating the setting of the limit switches. Moreover, the limit switches are difficult to adjust accurately.

The present inventors have addressed the problems connected with conventional winches.

SUMMARY OF THE INVENTION

The present invention provides a winch having a chainless and beltless drive comprising two drives orthogonally arranged one to the other on a one piece reduction gearing member. The reduction gearing member may conveniently be made from reinforced polymeric material. Such a one piece reduction gearing member may allow manufacture of a compact winch with drive integrity which may be improved over that of conventional winches. Moreover, the number of components is reduced in comparison with those of conventional winches thereby potentially reducing cost and labour in manufacture.

More particularly the invention provides a chainless drive winch comprising a cable cylinder rotatable about an elongate axis, the cylinder comprising a cable winding portion adapted to receive or dispense cable, and a worm gear wheel at one end; a reduction gearing member rotatable about an axis orthogonal to the cable cylinder, the reduction gearing member comprising a helical worm meshing with said worm gear wheel, and a driven worm gear wheel; and drive means having a helical drive worm on a drive shaft, the helical drive worm meshing with the driven worm gear wheel of the reduction gearing member. Additional reduction gearing may be provided through the helical drive worm with the driven worm gear wheel.

Preferably the cable winding portion and the worm gear wheel of the cable cylinder are integral with each other and may be cast metal, for example, aluminum, or molded from a self lubricating polymeric material such as filled nylon or polytetrafluoroethylene filled acetal.

The reduction gearing member may also be machined or molded in one piece from a metal or a self lubricating plastics material, such as filled nylon or polytetrafluoroethylene filled acetal.

Usually the drive means is an electric motor although for some small models there is no reason why a handle should not be provided for manual operation.

A pair of limit switches may be provided, the positions of which are adjustable to adjust the distance between them. A trigger is movable between the limit switches in dependence on an amount and direction of rotation of the rope cylinder, the trigger acting on each limit switch to alter operation of the electric motor to stop it. The movement of the trigger may be through a trigger gear wheel meshing with the worm gear at one end of the cable cylinder to drive a threaded shaft causing axial movement of a trigger nut on the shaft.

A brake may be provided on the reduction gearing member so that braking is not wholly dependent on stopping rotation of the cable cylinder which may be liable to back drive. A uni-directional clutch acts on the brake to allow unbraked rotation of the cable cylinder in one direction for a lifting operation and to brake rotation of the cable cylinder in another direction for lowering.

The brake may comprise an axial frustro-conical cavity in an upper end of the reduction gearing member, a brake cone held stationary to frictionally drag in said cavity to inhibit rotation of the reduction gearing member in one direction for lowering, and free to rotate to firmly engage in said cavity to allow rotation of the reduction gearing member in the other direction for lifting, and bearing means biasing said brake cone into said cavity; and the unidirectional clutch is operable on the bearing means to hold it stationary.

The cable winding portion of the cable cylinder preferably has helical grooves to locate cable. A roller may be provided generally parallel and adjacent the cable winding portion to bias cable into the helical grooves. The roller may be supported through independent torsion springs at each end portion to apply radial force to the roller to bias it towards the cable on the cable cylinder while allowing angular diversions from parallel so that, when cable is partially unwound from the cylinder bias will be preferentially exerted on the remaining turns of rope.

Preferably the winch includes a housing having opposed side walls, a top wall, a bottom wall and a front wall in which the cable cylinder is supported in bearings in the opposed side walls and the reduction gearing member is supported between the top and bottom walls, the side, top, bottom and front walls being located with respect to each other by tabs of the top and bottom walls locatable in corresponding slots of the side and front walls and tabs of the front wall locatable in notches in front vertical edges of the side walls. The bottom wall may be located above bottom edges of the side wall.

A further advantage may be that the drive system utilizes self-lubricating composite material eliminating the need for lubricating oil. As a result the winch may be installed in any orientation without concern for lubricant leakage.

BRIEF DESCRIPTION OF THE DRAWINGS

An embodiment of the invention will now be described by way of example with reference to the drawings, in which.

DETAILED DESCRIPTION OF A PREFERRED EMBODIMENT

The drawings show a winch 10 having a housing 12 and a electric motor 14. The winch housing is constructed of accurately interlocking plates to maintain accurate geometry of the gears and other working parts. The plates have intermeshing tongues and slots to ensure precise assembly and to absorb a portion of the shear loads in the frame assembly. This permits lighter construction of the housing with no decrease in safety factor.

Figure 1:
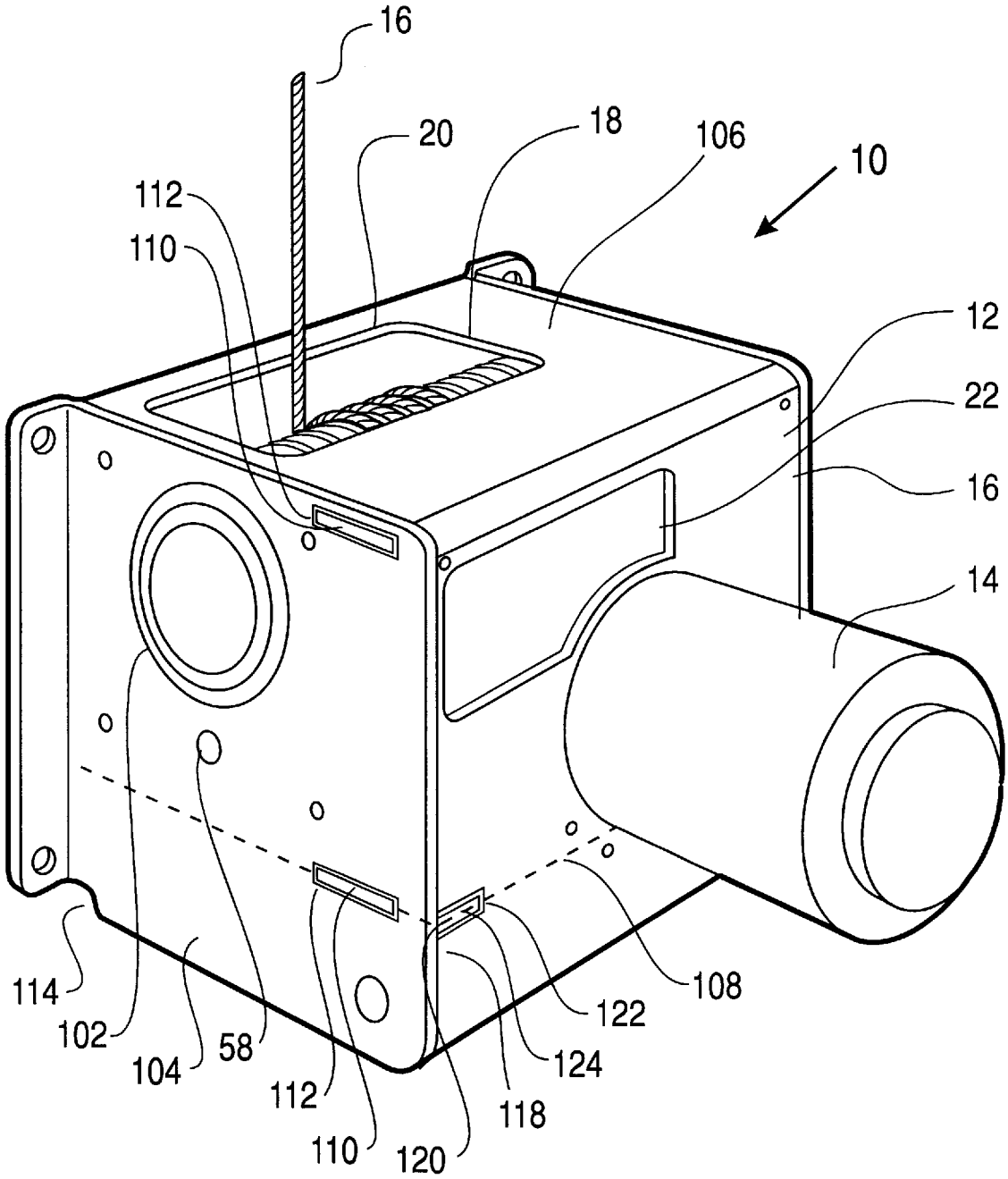
FIG. 1 shows and isometric view of a winch according to the invention.
Figure 3:
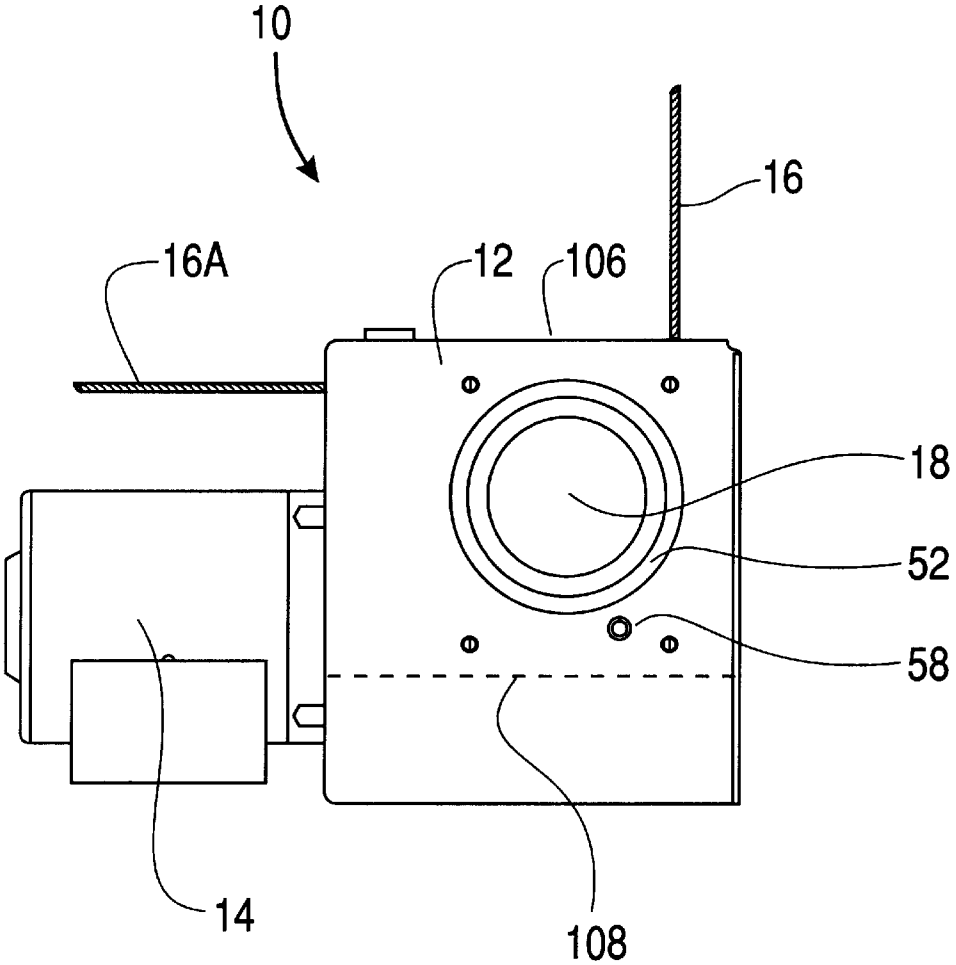
FIG. 3 shows a side view of the winch as shown in FIG. 1.
Figure 2:
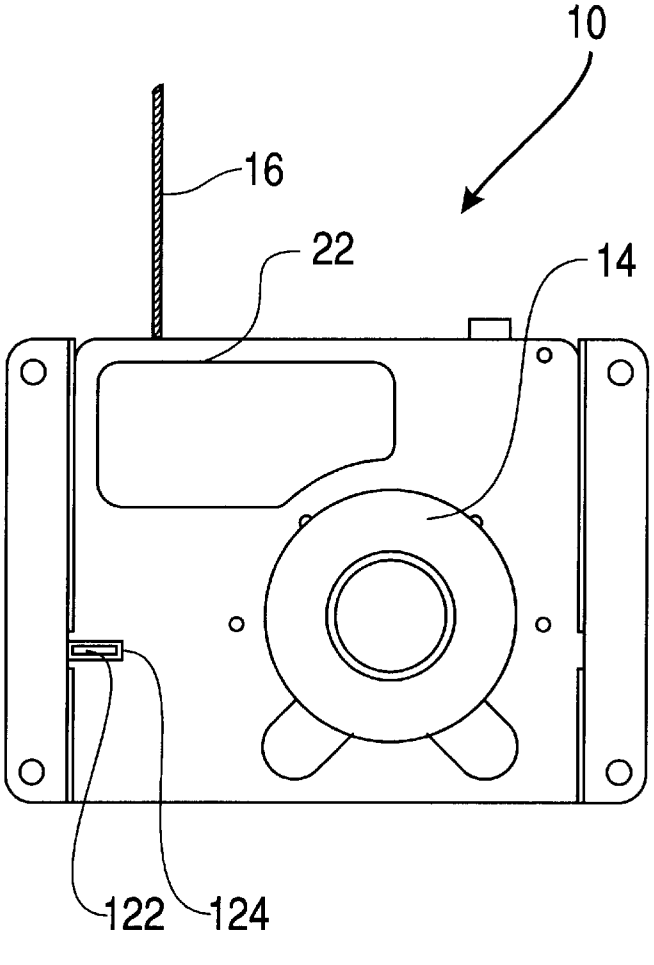
FIG. 2 shows a front view of the winch of FIG. 1.
Figure 4:
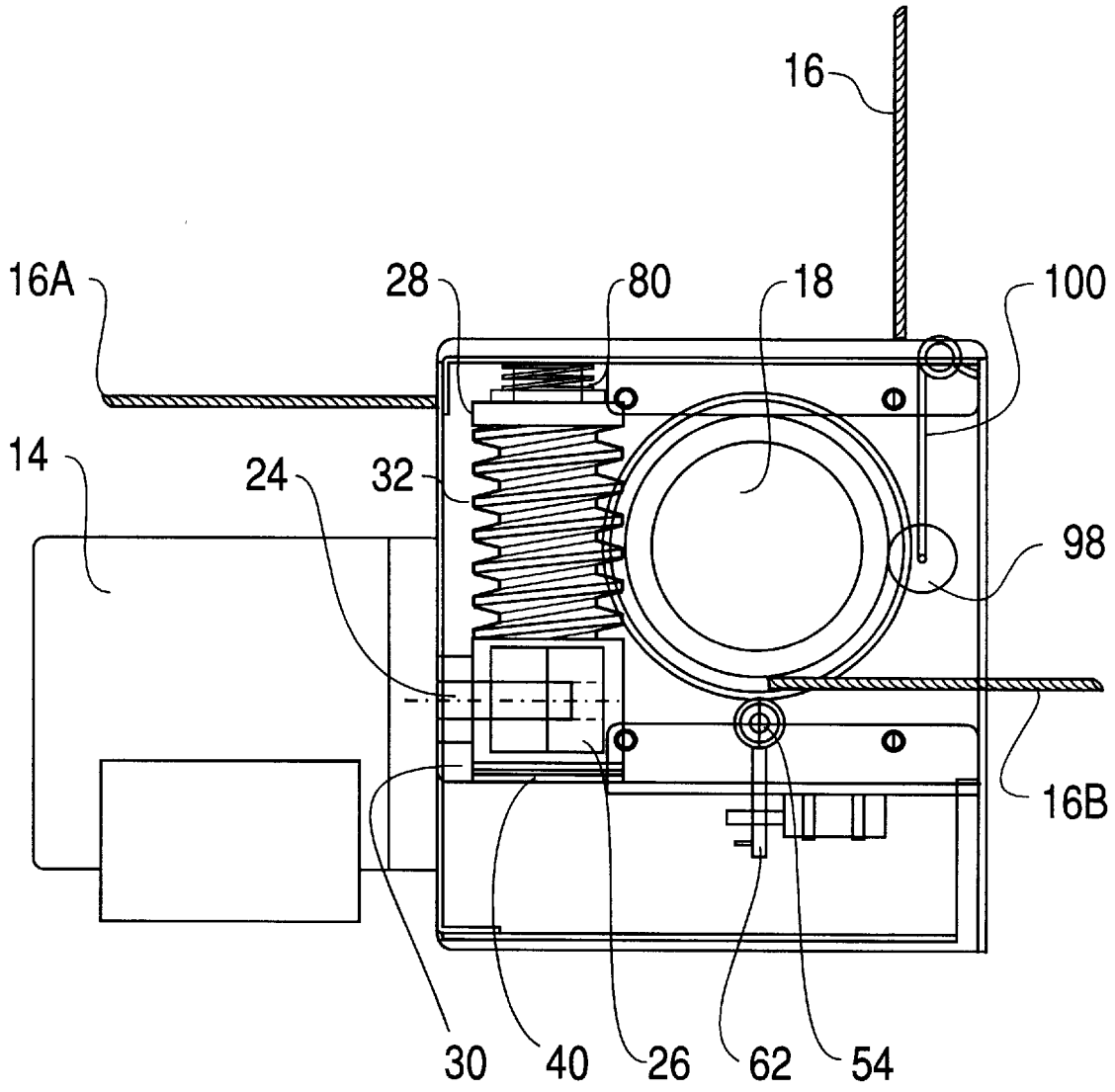
FIG. 4 is a view from the side somewhat similar to FIG. 3 but viewed from within the housing showing operation components.

Rope 16 is usually led vertically onto a rope cylinder 18 through a top aperture 20 in which housing 12. However, the winch housing 12 may be provided with front aperture 22 and an aperture at the rear so that rope 16 may be lead onto the rope cylinder from the front or the rear. These alternative directions for leading the rope onto the rope cylinder 18 are best seen in FIG. 4 where they are respectively labelled 16A and 16B.

The electric motor 14 has a drive shaft 24 extending into the winch housing 12, a drive worm 26 is provided on the drive shaft.

Within the winch housing 12 a two-stage, one piece, single axle reduction gearing member 28 has a primary worm wheel 30 having parallel gear grooves at an angle to the axis and secondary helical worm 32 about the circumference of member 28. Primary worm wheel 30 engages drive worm 26 of electric motor 14 which may be formed of porous impregnated Oilite (Trademark) bronze or of a self lubricating polymeric material and secondary worm 32 engages a worm wheel 34 on rope cylinder 18. Reduction gearing member 28 may be machined or molded from Nylatron NSM (Trademark). It may, however, also be molded from other self-lubricating polymeric components such as Teflon (Trademark) filled acetal or filled nylon. Primary worm wheel 30 is provided as a series of axially angled gear grooves about an end portion of molded reduction gearing member 28. The gear grooves of worm 30 engage teeth of drive worm 26, the drive shaft of electric motor 14 extending at right angles to the axis of reduction gearing member 28.

Figure 5:
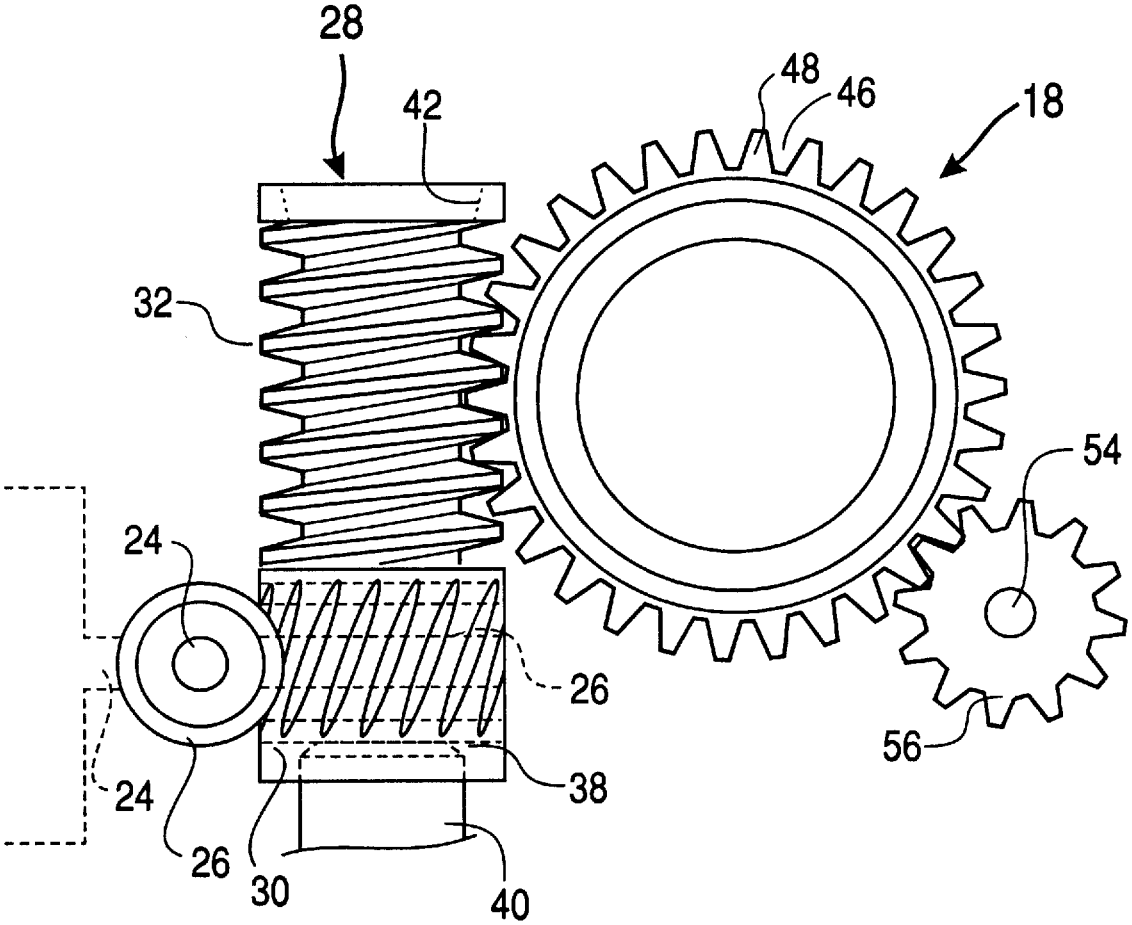
FIG. 5 is a simplified view of some of the essential working components of FIG. 4.
Figure 6:
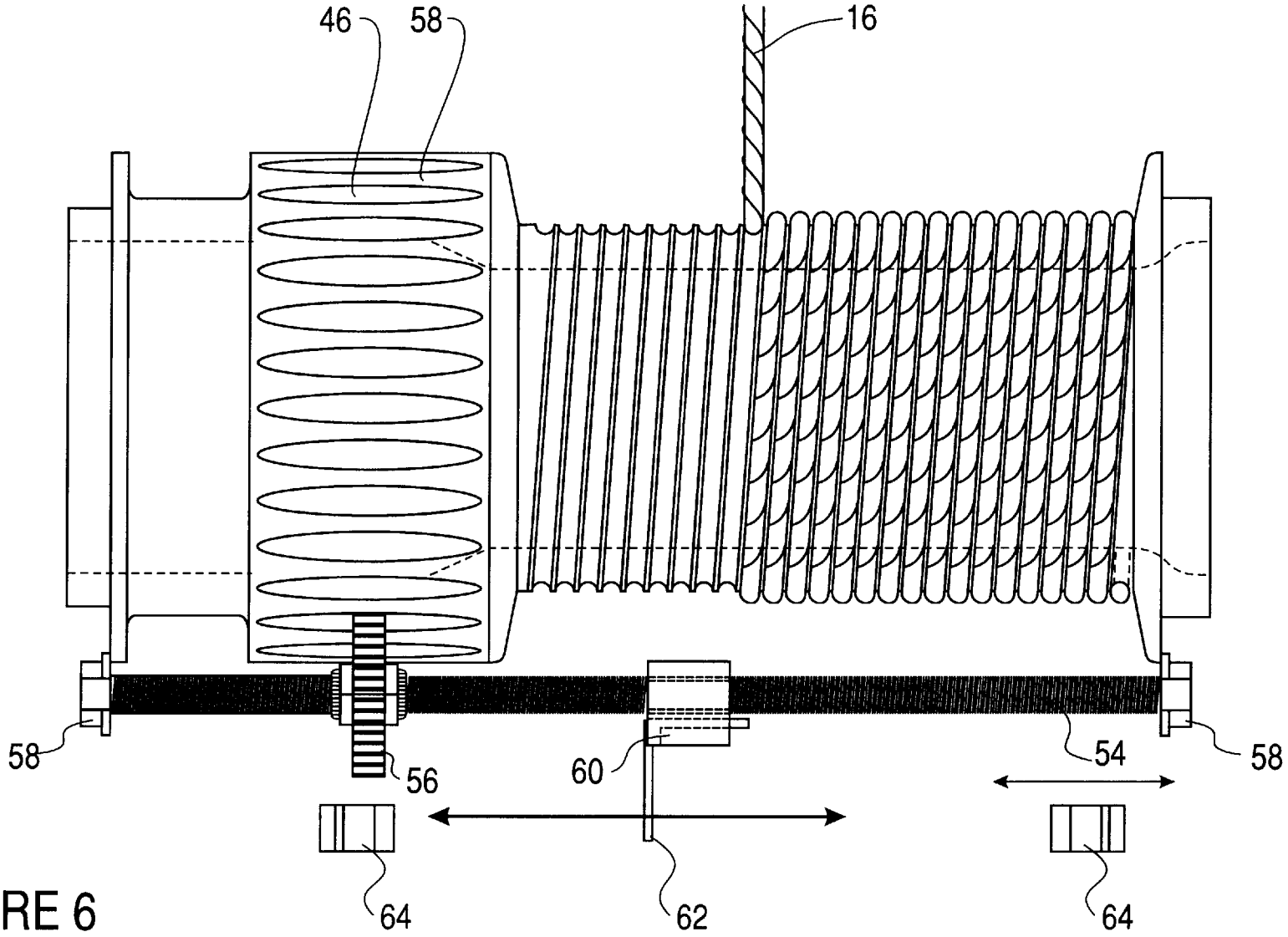
FIG. 6 is a view of the rope cylinder of the winch of the previous figures.
Figure 7:
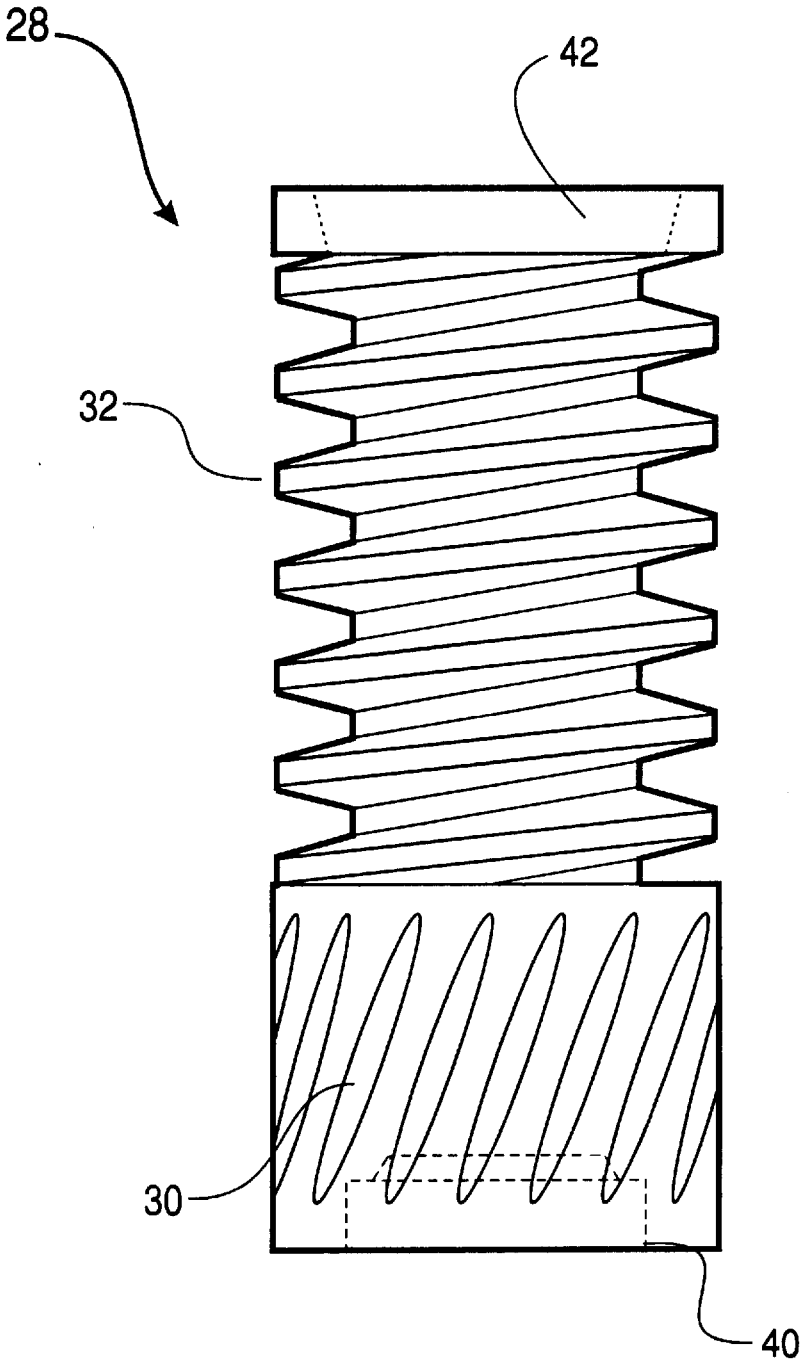
FIG. 7 is a view of the one piece molding reduction gearing member of the winch of the previous Figures.

Secondary worm of reduction gearing member 28 comprises a helical gear groove about the body of reduction gearing member 28. The helical gear groove of secondary worn 32 engages the worm wheel 34 of rope cylinder 18, the axis of which is at right angles to the axis of reduction gearing member 28. By this mechanism the rotation of electric motor 14 through drive shaft 24 is translated into rotation of rope cylinder 18 which is located at right angles to drive shaft 24. This relative location of gearing is best seen from FIGS. 4 and 5. In FIG. 5 the drive worm 26 is shown rotated through 90° for clarity although the actual position of the drive worm 26 is shown in dotted lines.

The reduction gearing member 28 has a cavity 36 in its lower end 38 for location on a bearing 40 on which reduction gearing member is freely rotatable.

Reduction gearing member 28 has frustro-conical cavity 42 in its upper end 44 for engagement with a brake cone as will be described hereinafter.

Rope cylinder 18 comprises a member either cast in metal, e.g. aluminum, or molded in one piece from reinforced self-lubricating material similar to that used to form the reduction gearing member 28. In one end region of rope cylinder 18, worm wheel 34 comprises a narrow cylindrical part having axial gear grooves 46 lying between gear ridges 48. The body of the cylinder is provided with a helical groove 50 into which rope 16 is wound.

The operation of the winch thus far described is similar to the operation of conventional winches except for the one part construction of reduction gearing member 28 from self-lubricating material and the similar construction of rope cylinder 18. When drive shaft 24 is rotated by means of electric motor 14, drive worm 26 engages primary worm 30 of reduction gearing member 29 to rotate reduction gearing member 28 about its vertical axis as reduction gearing member 28 rotates about its vertical axis worm 34 of rope cylinder 18 engages with helical secondary worm 32 of reduction gearing member 28. Thus rope cylinder 18 is caused to rotate about its horizontal axis at right angles to drive shaft 24. As rope cylinder 18 rotates about its horizontal axis, rope 16 is wound onto the helical groove 50 thereof. The reduction gearing member 28 operates as reduction gearing between the electric motor and the rope cylinder 18. The actual reduction is due to the angle of the gear grooves of worm 30 in respect to the axis of reduction gearing member 28. The extent of the reduction gearing is dependent upon the loads on which the winch is to be used. The first stage may for example have 17 teeth on wheel 30 mated with a 3-start worm 26 to give a 17:3 (5.66:1) ratio. The second stage may have a ratio of 27:1 for a total of 153:1.

The rope cylinder 18 has a bearing projection at each end which bears in a bearing 52 of sidewalls of the housing 12.

The winch features an improved limit switch arrangement. The limit switch drive provides 3 times more travel of the limit switch trip nut per foot of rope wound on or off, giving much improved accuracy of the limit adjustments.

A further improvement is gained by providing slidable adjustment of the actual limit switches in place of the usual adjustment of the position of the travelling nut(s). This is a much simplified and more accurate way of setting the stop positions.

A mechanism is provided for travel limit switch drive for the rope. Below the rope cylinder 18 and parallel with it is a threaded shaft 54 having a gear wheel 56 thereon. The gear wheel 56 meshes with worm wheel 34 of rope cylinder 18. A threaded shaft 54 has end bearings 58 located in bearing apertures of the sidewalls of housing 12. Threaded shaft 54 is rotated through meshing of drive wheel 56 with worm 34. A travel nut 60 is provided on threaded shaft 54 which moves to and fro long the shaft in the one axial direction or the other on rotation of the shaft. A trip finger 62 depends from travel nut 60 to move between two limit switches may be altered by sliding the switch 64 in a slot in the base of the housing, thus reducing or increasing the amount of travel allowed of travel nut 60 before trip finger' 62 contacts switch 64 to switch off electric motor 14 to stop.

A braking system is provide which operates on the reduction gearing member 28 rather than relying solely on a negative reverse efficiency of a worm gear drive system. The pre-loaded brake is built into the reduction gearing member 28 to ensure positive stopping and holding of the member. A unidirectional clutch allows a brake cone to rotate with the drive pinion while running in the "up", or lifting, direction, but holds the brake cone stationary while lowering. The brake surface then generates frictional drag against the mating surface of the drive pinion, creating the required braking effect.

As has been described herein before, reduction gearing member 28 rotates on bearing 40 at its lower end. At its upper end reduction gearing member 28 is provided with an axial frustro-conical cavity 42. In its unbraked condition, when driven by electric motor 14 to lift an article with the winch, reduction gearing member 28 and a brake cone 70 located fixedly in cavity 42 rotate together. When reduction gearing member 28 is driven in the opposite direction to lower the article, a conventional unidirectional clutch 82, is operated to stop rotation of the brake cone 70. There is now frictional drag between the surface of the brake cone 70 and the surface of the cavity 42 exerting a braking effect.

Operation of the brake is described with reference to FIG. 9. A top bearing bolt 72 passes through an aperture in a top wall of housing 12 and screw threadedly engages an axial socket of a clutch pin 74 secured in clutch 82 against rotation in one direction while allowing rotation in the other direction. A coil spring 80 bears, on the one hand, against top wall of housing 12. A washer 76 fits inside spring 80 to locate it and, on the other hand, against brake cone 70 through washer 86 and bearing 88, biasing the brake cone 70 into engagement with reduction gearing member 28.

The brake cone 70 is at all times in firm contact against cavity 42, the force being supplied by the spring 80. The spring does not rotate and the needle thrust (flat) bearing 88 allows the force to be applied without the spring rubbing against the brake cone. Therefore the top of member 28 is firmly guided by the radial bearing capacity of the brake clutch 82. When electric motor 14 is operated to provide lifting, pin 74 slips in clutch socket 82 so that brake cone 70 and reduction gearing member 28 together turn in unbraked fashion powered by the motor. When electric motor 14 is operated to provide lowering, pin 74 engage clutch socket 82 so brake cone 70 drags frictionally in cavity 42 to provide braking.

Member 28 and brake cone 70 rotate together in "up" direction, therefore the brake cone provides firm radial support but no drag in "up" direction. In the "down" direction uni-directional clutch 82 locks onto pin 74, holding brake cone 70 stationary and therefore provides braking torque via friction against the wall of cavity 42 while continuing to guide worm 28 radially.

Figure 9:
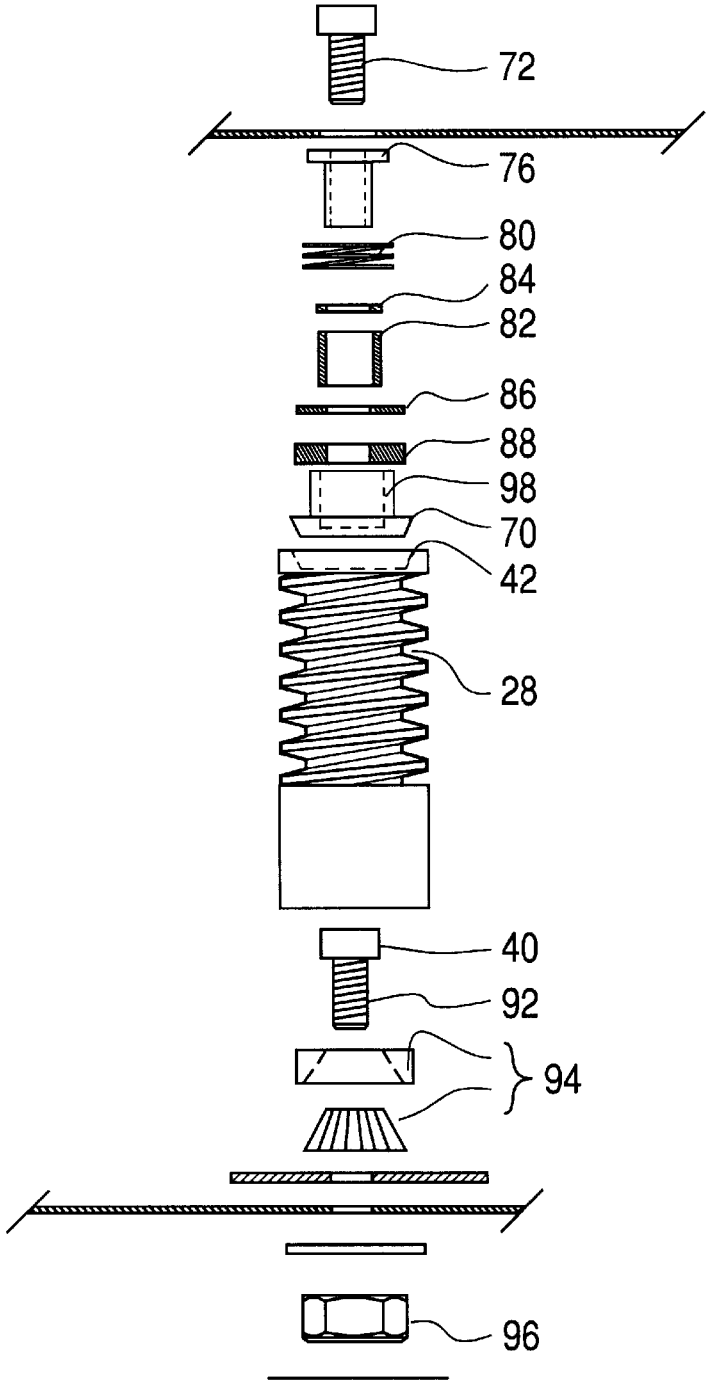
FIG. 9 shows an exploded view of the braking system for a winch as shown in the previous Figures.

FIG. 9 also shows in more detail the lower bearing 40 of reduction gearing member 48. Lower bearing 40 comprises a bearing bolt 92 projecting through a tapered roller thrust bearing 94 and a washer flush with the lower surface of housing 12 and fixed by nut 96.

Figure 8B:
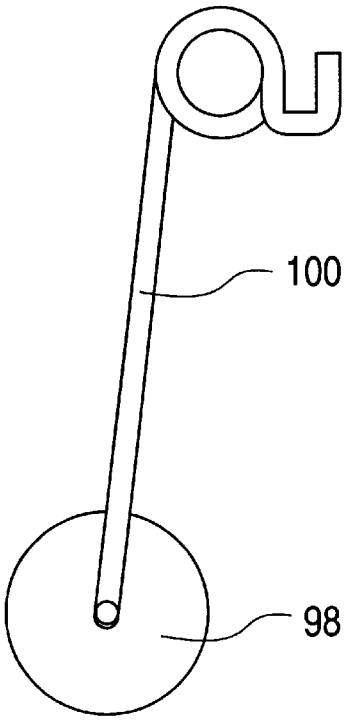
FIGS. 8A and 8B show a view of a rope cylinder pressure roller for trapping rope in helical grooves of the rope cylinder.
Figure 8A:
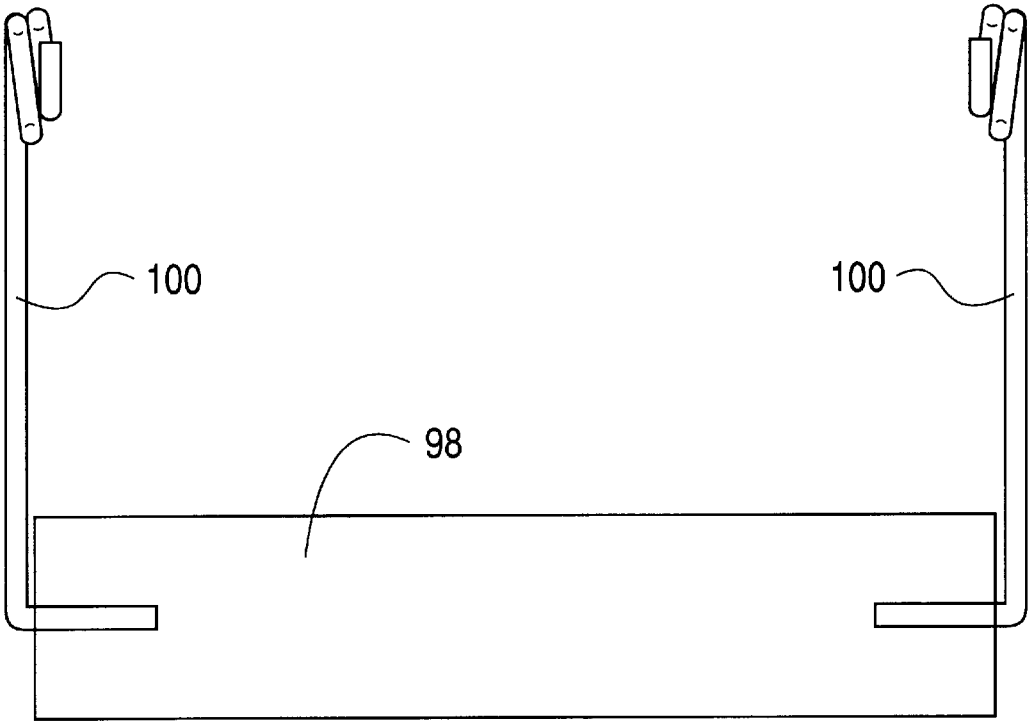

FIGS. 8A and 8B shows a small diameter roller 98 located parallel with the body of rope cylinder 18. The small diameter roller 98 has a length corresponding to the body of rope cylinder 18 having helical groove 50. The roller 98 lies adjacent the helical groove 50 and traps rope in the helical grooves. The roller 98 has a resilient surface to enhance its action. The effectiveness of roller 98 is further enhanced by a pair of supporting torsion springs 100 which provide dual functions of both axles for roller 98 and a means of applying radial force to the roller 98. At least torsion spring 100 at the end of helical groove 50 containing the distal end of rope 16 may be arranged to supply substantial radial force to the roller. The torsion springs 98 also allow the roller to move out of parallel to the cylinder axis, thereby tending to exert additional pressure on the last turn of the rope on the cylinder which in turn prevents any loosening of preceding turns. The end of the rope is passed through a hole in the wall of the cylinder and doubled back through a standard U-clamp which pulls up against the inside of the diameter of the cylinder 18. Rope can not pull through this system and the radial force supplied by roller 98 enhances the security on the rope.

The rope cylinder 18 is supported in bearings 102 between sidewalls 104 in the housing 12 and member 28 is supported between top and bottom walls 106, 108. For free operation of the machinery it is extremely important that the location of the bearings are accurate and the housing parts fit accurately together. Downward forces due to the weight of articles to be lifted by the winch impose strains on the housing tending to distort it. To locate top wall 106 and bottom wall 108 accurately between sidewalls 104, top and bottom walls are formed with tabs 110 to engage accurately stamped slots 112 in side walls 104. The bottom wall 108 is located above the bottom edges 114 of side walls 104. A front wall 116 is also provided having, on the one hand, sideways projecting tabs 118 fitting into notches 120 of the side walls 104, and on the other hand slots 122 accepting tabs 124 of the bottom wall 108. This interlocking system of tabs 110, 118 and 124 with slots 112, notches 120 and 122 respectively forms a firm interactive engagement between the walls 104, 106 and 116 tending to counter the downward forces due to the action of the winch. Additional bolts may easily be inserted between flanges of the top and bottom walls and the side walls and front wall after accurate location of them through the tabs and slot system.

I claim:

1. A chainless drive winch comprising:

a cable cylinder rotatable about an elongate axis, the cylinder comprising a cable winding portion adapted to receive or dispense cable, integral with a worm gear at one end;

a reduction gearing member rotatable about a axis orthogonal to the cable cylinder, the reduction gearing member comprising a helical worm meshing with said worm gear, and a driven worm wheel;

drive means having a helical drive worm on a drive shaft, the helical drive worm meshing with the driven worm wheel of the reduction gearing; a brake on the reduction gearing member and a uni-directional clutch adapted to allow unbraked rotation of the cable cylinder in one direction for a lifting operation and adapted to brake rotation of the cable cylinder in another direction for lowering.

2. A chainless drive winch as claimed in claim 1 in which the brake comprises an axial frustro-conical cavity in an upper end of the reduction gearing member, a brake cone frictionally engaged in said cavity, a uni-directional clutch being provided to engage the brake cone stationary when the electric motor is operated in one direction whereby braking is provided due to frictional drag between said brake cone and said cavity and to allow the brake cone to rotate when the electric motor is operated in the other direction, whereby said brake cone rotates with the reduction gearing member.

3. A chainless drive winch as claimed in claim 1 in which the cable cylinder is cast metal.

4. A chainless drive winch as claimed in claim 1 in which the cable cylinder is molded from a self lubricating polymeric material selected from the group consisting of nylon and polytetrafluoroethylene filled acetal.

5. A chainless drive winch as claimed in claim 4 in which the reduction between said driven worm gear wheel and said helical worm is in the region of 27:1.

6. A chainless drive winch as claimed in claim 1 in which the reduction gearing member is molded or machined in one piece from a self lubricating plastics material selected from the group consisting of polytetrafluoroethylene filled acetal and nylon.

7. A chainless drive winch as claimed in claim 1 in which the drive means is an electric motor and including a pair of limit switches the positions of which are adjustable to adjust the distance between them, a trigger movable between the limit switches in dependence on an amount and direction of rotation of the rope cylinder, the trigger acting on each limit switch to alter operation of the electric motor.

8. A chainless drive winch as claimed in claim 7 in which the trigger is movable through a trigger gear wheel meshing with the worm gear at one end of the cable cylinder.

9. A chainless drive winch as claimed in claim 1 in which the cable winding portion of the cable cylinder has helical grooves to locate cable, and in which is provided a roller generally parallel and adjacent the cable winding portion to bias cable into the helical grooves.

10. A chainless drive winch as claimed in claim 9 in which the roller is supported through torsion springs at each end portion to apply radial force to the roller while allowing angular diversion from parallel.

11. A chainless drive winch comprising:

a cable cylinder rotatable about an elongate axis, the cylinder comprising a cable winding portion adapted to receive or dispense cable, integral with a worm gear at one end;

a reduction gearing member rotatable about a axis orthogonal to the cable cylinder, the reduction gearing member comprising a helical worm meshing with said worm gear, and a driven worm wheel; and a housing having opposed side walls, a top wall, a bottom wall and a front wall, in which the cable cylinder is supported in bearings in the opposed side walls and the reduction gearing member is supported between the top and bottom walls, the side, top, bottom and front walls being located with respect to each other by tabs of the top and bottom walls locatable in corresponding slots of the side and front walls and tabs of the front wall locatable in notches in front vertical edges of the side walls.

12. A chainless drive as claimed in claim 11 in which the bottom wall is located above bottom edges of the side walls.

13. A chainless drive winch as claimed in claim 11 in which the cable cylinder is cast metal.

14. A chainless drive winch as claimed in claim 11 in which the cable cylinder is molded from a self lubricating polymeric material selected from the group consisting of nylon and polytetrafluoroethylene filled acetal.

15. A chainless drive winch as claimed in claim 11 in which the reduction gearing member is moulded or machined in one piece from a self lubricating plastics material selected from the group consisting of polytetrafluoroethylene filled acetal and nylon.

16. A chainless drive winch as claimed in claim 15 in which the reduction between said driven worm gear wheel and said helical worm is in the region of 27:1.

17. A chainless drive winch as claimed in claim 11 in which the drive means is an electric motor and including a pair of limit switches the positions of which are adjustable to adjust the distance between them, a trigger movable between the limit switches in dependence on an amount and direction of rotation of the rope cylinder, the trigger acting on each limit switch to alter operation of the electric motor.

18. A chainless drive winch as claimed in claim 17 in which the trigger is movable through a trigger gear wheel meshing with the worm gear at one end of the cable cylinder.

19. A chainless drive wheel as claimed in claim 11 in which the cable winding portion of the cable cylinder has helical grooves to locate cable, and in which is provided a roller generally parallel and adjacent the cable winding portion to bias cable into the helical grooves.

20. A chainless drive winch as claimed in claim 19 in which the roller is supported through torsion springs at each end portion to apply radial force to the roller while allowing angular diversion from parallel.

* * * * *